US005158253A

United States Patent [19]

Burghoff et al.

[11] Patent Number: 5,158,253

[45] Date of Patent: Oct. 27, 1992

[54] RAILWAY TRACK MOUNTING ARRANGEMENT

[75] Inventors: Jürgen Burghoff, Hattingen; Werner Heesen; Rainer Wolber, both of Essen, all of Fed. Rep. of Germany

[73] Assignee: Tiefenbach GmbH, Essen, Fed. Rep. of Germany

[21] Appl. No.: 699,770

[22] Filed: May 14, 1991

[30] Foreign Application Priority Data

Jul. 25, 1990 [DE] Fed. Rep. of Germany ..... 4023565

[51] Int. Cl.[5] ..... B61L 13/02

[52] U.S. Cl. ..... 246/246; 246/249; 248/295.1

[58] Field of Search ..... 246/193, 246, 247, 249, 246/248, 250, 169 R, 182 R, 167 A, 202; 238/310, 338, 1; 248/295.1, 297.2, 296, 298; 74/89.15; 403/4, 408.1, 388

[56] References Cited

U.S. PATENT DOCUMENTS

| | | | |
|---|---|---|---|
| 734,341 | 7/1903 | Lee | 246/246 X |
| 2,435,365 | 2/1948 | Post | 246/246 X |
| 2,452,480 | 10/1948 | Mason | 246/246 |
| 3,558,875 | 1/1971 | Gieskieng | 246/249 X |
| 3,702,396 | 11/1972 | Pavlve | 246/248 |
| 3,941,338 | 3/1976 | Knudsen | 246/247 X |
| 4,076,192 | 2/1978 | Hoge | 246/247 |
| 4,283,031 | 8/1981 | Finch . | |
| 4,407,072 | 10/1983 | Hoskins, Jr. | 246/169 R X |
| 4,444,540 | 4/1984 | Blatt et al. | 74/89.15 X |
| 4,753,403 | 6/1988 | Chew . | |

FOREIGN PATENT DOCUMENTS

| | | | |
|---|---|---|---|
| 625389 | 11/1962 | Belgium | 246/247 |
| 0342526 | 11/1989 | European Pat. Off. . | |
| 695741 | 8/1940 | Fed. Rep. of Germany . | |
| 936454 | 12/1955 | Fed. Rep. of Germany | 246/249 |
| 1044861 | 5/1958 | Fed. Rep. of Germany | 246/247 |
| 974202 | 10/1960 | Fed. Rep. of Germany . | |
| 1195797 | 4/1961 | Fed. Rep. of Germany | 246/246 |
| 1516589 | 5/1969 | Fed. Rep. of Germany . | |
| 2712365 | 9/1978 | Fed. Rep. of Germany . | |
| 8533479 | 2/1986 | Fed. Rep. of Germany . | |
| 507096 | 6/1920 | France | 246/247 |
| 2350239 | 12/1977 | France . | |
| 2473449 | 7/1981 | France . | |
| 363405 | 12/1931 | United Kingdom | 246/246 |
| 449985 | 7/1936 | United Kingdom | 246/247 |
| 1089969 | 11/1967 | United Kingdom | 246/249 |

*Primary Examiner*—Michael S. Huppert
*Assistant Examiner*—Robert S. Katz
*Attorney, Agent, or Firm*—Bell, Seltzer, Park & Gibson

[57] ABSTRACT

An apparatus is disclosed for adjusting the height of a monitor with respect to the rail head of a rail having a first bracket adapted to be connected to the rail and a secured bracket adapted to be connected to the monitor, the brackets are releasably connected to each other by a vertically movable slide arrangement comprising mating surfaces one of them having an elongate recess and the other having a complementary protrusion to prevent relative tilting or canting of the brackets.

9 Claims, 2 Drawing Sheets

Fig. 1.
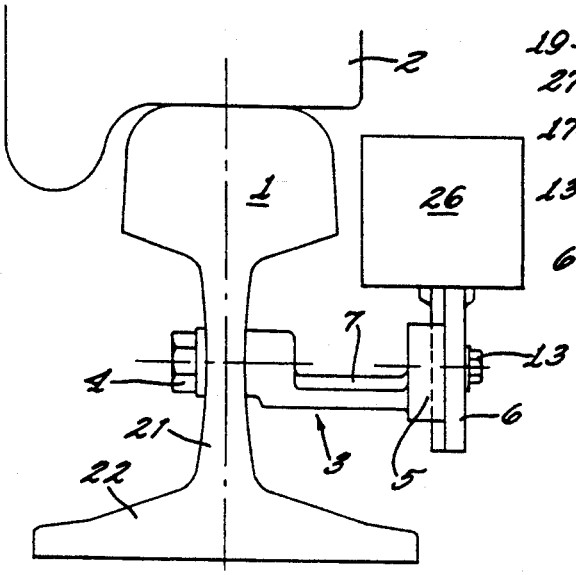
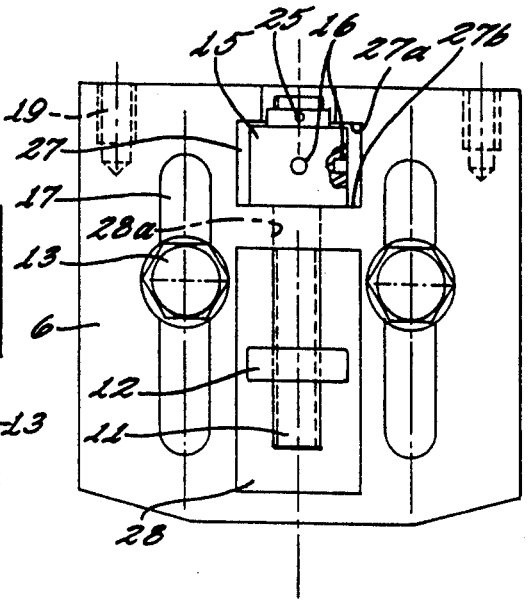
Fig. 4.
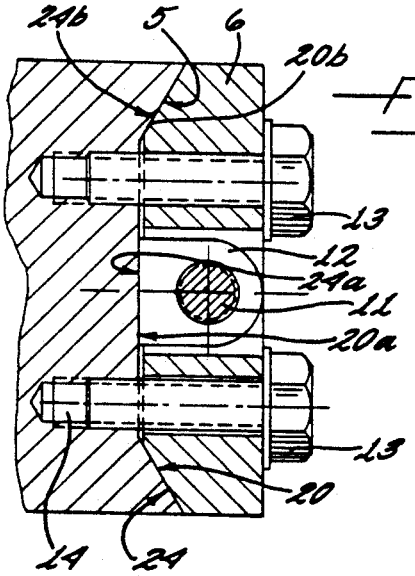
Fig. 3.
Fig. 2.
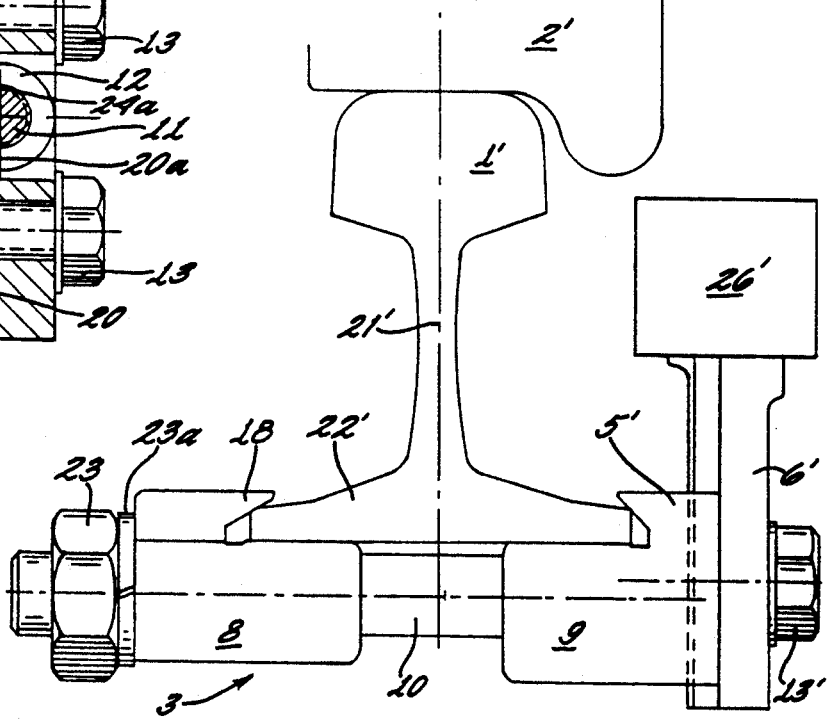

RAILWAY TRACK MOUNTING ARRANGEMENT

BACKGROUND OF THE INVENTION

1. Field of the Invention

The invention in general relates to an apparatus for mounting a monitor to a rail of a railway track and, more particularly, to an apparatus which permits periodic adjustments in the position of the monitor relative to the rail head of a rail.

2. Description of the Prior Art

Such arrangements are well-known in the art and serve to position monitoring devices such as transducers or railway switches, and the like in as precise a position relative to the rail head of a rail as possible to ensure proper and flawless operation of the monitor. The rails, under the impact of traffic, are subject to considerable wear and tear resulting in a gradual lowering or disfiguring of the running surface of the rail head and, accordingly, periodic adjustments in the position of the monitor relative to the rail head is indicated. The monitors, as is well-known, serve to release signals in response to approaching wheels, and the signals are in turn utilized to actuate ancillary equipment such as warning lights or road crossing barriers and the like.

One arrangement of the kind under consideration is disclosed by European patent specification 0 342 526. Vertical movement of a monitor in accordance with that arrangement is accomplished by two vertically disposed adjustment bolts by means of which a mounting bracket may be moved relative to another mounting bracket. The adjustment bolts are provided with axial bores in which threaded bolts are seated for connecting the monitor to the brackets. In order to adjust the position of the monitor relative to the level of a rail head it is, therefore, necessary first to release bolts which maintain the relative position of the two brackets, thereafter to loosen the mounting bolts, and then to rotate the adjustment bolts for repositioning the monitor. Subsequent to the repositioning of the monitor the mounting bolts and the clamping bolts have to be tightened again.

Another arrangement is known from U.S. Pat. No. 4,753,403. The arrangement utilizes a lockable arrangement attached to the base of a rail for supporting a mounting bracket for a monitor. Each of two clamps is provided with a lug which serves to support the mounting bracket by means of a bolt threadedly received in the lug and extending through a vertical elongate slot in the bracket. Heightwise adjustment of the monitor requires loosening of the bolt in each lug and depends in no small measure upon the skill of the person attempting the heightwise adjustment by manually raising or lowering the monitor and maintaining its new position until the mounting bolts are again tightened.

Arrangements of the kind described in the prior art are disadvantageous in that they are either unduly complicated in their construction and utilization. Moreover, they may be subject to jamming during their heightwise repositioning.

It is, therefore, an object of the present invention to provide a mounting arrangement for a rail monitor which while structurally simple facilitates precise periodic adjustments in the position of the monitor relative to a rail.

It is a further object of the invention to provide a mounting arrangement for a monitor of the kind under consideration which includes a vertically disposed slide arrangement for accurately guiding the monitor during vertical movements necessary for its positional readjustments.

Yet another object of the invention resides in the provision of a positive vertical guide in the mounting arrangement of a monitor to prevent tilting or canting in directions parallel to the rail and possible jamming.

SUMMARY OF THE INVENTION

In the accomplishment of these and other objects the invention provides, in an apparatus for adjusting the position of a monitoring device relative to the rail head of the rail, a bracket adapted to be affixed to the rail and having a substantially vertically disposed surface and another bracket for supporting the monitoring device for selective vertical movement in engagement with the surface. The surfaces are respectively provided with a vertically disposed recess and protrusion of complementary cross-section or configuration. The brackets are releasably connected to each other with the surfaces in mating engagement. The surfaces serve as slides by means of which the brackets may be moved relative to each other in a substantially straight path by means of a drive spindle arrangement.

Other objects of the invention will in part be obvious and will in part appear hereinafter.

BRIEF DESCRIPTION OF THE DRAWINGS

The invention will now be described in connection with preferred embodiments, with reference to the accompanying drawings, in which:

FIG. 1 is an elevational view of a first embodiment of the invention;

FIG. 2 is an elevational view of a second embodiment of the invention;

FIG. 3 is a cross-sectional view, on an enlarged scale, of a first configuration of mating surfaces between rail and monitor mounting brackets;

FIG. 4 is a front elevational view, partially in section, depicting details of one of the mounting brackets.

DESCRIPTION OF THE INVENTION

Figure 3A:
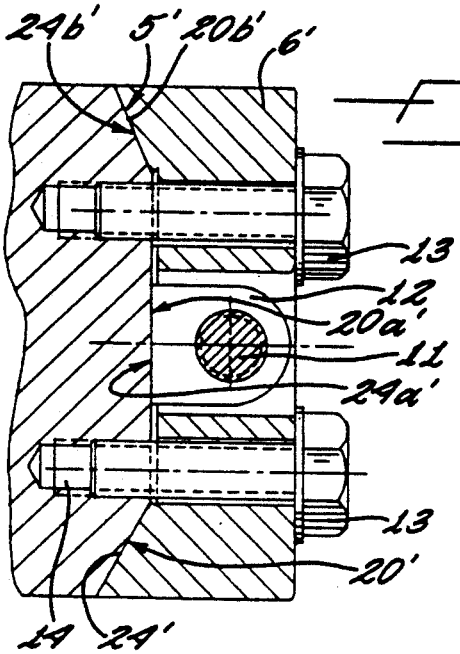
FIG. 3*a* is a view similar to FIG. 3, depicting an alternate surface configuration.

A first embodiment of an apparatus 3 in accordance with the invention is depicted in FIG. 1. A support bracket 7 is rigidly connected, in a substantially horizontal orientation, to a rail 21 intermediate the head 1 and base 22 thereof by means of one or more bolts 4 (only one shown). A wheel 2 is schematically indicated as being positioned on the rolling surface of the rail head 1. The free end of the bracket 7 is provided with a guide surface 5 to be described in detail hereinafter. A carriage 6 serving to support the housing 26 of a monitor is seen to be attached to the guide surface 5 by bolts 13, in a predetermined elevational position relative to the wheel 2 or rail head 1. As will be appreciated by those skilled in the art, it is this relative position which is of utmost importance to the flawless operation of the monitor.

FIG. 2 in which similar elements are identified by similar but primed reference characters depicts an alternate embodiment of the invention. In this embodiment the mounting bracket consists of a clamping arrangement including first and second clamp portions 8 and 9 provided with lugs 18 engaging opposite marginal portions of the base 22' of a rail 21'. The clamp portion 8 is seated on a threaded spindle 10 extending from the clamp portion 9, and a nut 23 seated on the spindle 10 is provided to secure the engagement of the clamp portions 8 and 9 with the base 22 of the rail. A lock washer 23*a* may be seated between the nut 23 and an abutting surface of the clamp portion 8 to prevent unintentional loosening of the nut 23. The clamp portion 9 is provided with a guide surface 5'. A slide 6' is seen to be held in clamping engagement against the guide surface 5' by means of one or more bolts 13'. As in the embodiment described supra, the slide 6' permits adjustments in the elevational position of the housing 26' of a monitor relative to the rail head 1' or wheel 2'.

FIG. 3 is a cross-sectional view of a first configuration of a guide surface 5 and the abutting surface of the slide 6. The guide surface 5 is seen to consist of three parallel sections 20, 20*a* and 20*b*, sections 20 and 20*b* being positioned at acute angles relative to the section 20*a* in a direction toward the slide 6. The carriage or slide 6 is seen to be provided with a surface consisting of three parallel and vertically aligned sections 24, 24*a*, and 24*b* which complement the surface sections 20, 20*a*, and 20*b* and in the manner of this invention may selectively slide in engagement therewith. The surface sections 20, 20*a*, and 20*b* of the guide surface 5 may be said to constitute a groove, whereas the surface sections 24, 24*a*, and 24*b* function in the manner of a rail and constitute an elongated protrusion designed to mate with the groove. The groove and protrusion are respectively of female and male trapezoidal cross-sectional configuration.

The embodiment shown in FIG. 3*a* differs from that of FIG. 3 in that its arrangement is the reverse of the arrangement of FIG. 3, i.e., the guide surface 5' is configured as an elongate protrusion or rail comprising parallel portions 20', 20*a'*, and 20*b'*, whereas the slide 6' is provided with a mating groove made up of surfaces 24'. 24*a'*, and 24*b'*.

Figure 3B:
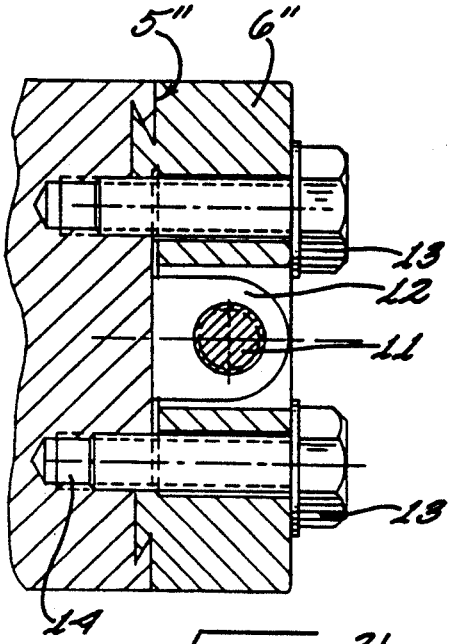
FIG. 3*b* is a view similar to FIG. 3, depicting a different mating surface configuration.

In FIG. 3*b* the mating surfaces of the guide surface 5'' and of the slide 6,, are seen to be joined in a dovetail arrangement, the mortises being provided in the guide surface 5'', the tenons being provided in the slide 6''.

Figure 3C:
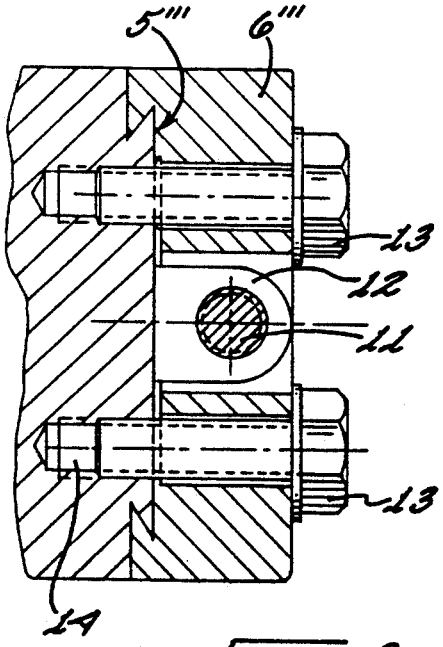
FIG. 3*c* is a view similar to FIG. 3, showing yet another mating surface configuration.

The arrangement of FIG. 3*c* also shows a dovetail joint between guide surface 5''' and slide 6'''. In this case, however, the tenons are in the guide surface 5''' and the mortises are provided in the slide 6'''.

The mating surfaces of the various exemplary embodiments shown are such that they may provide relative sliding movement, means to be described being provided, however, to prevent such movement in normal circumstances While the depicted embodiments all comprise trapezoidal interfacial relationships, other configurations such as semicircular, triangular or rectangular groove and rail arrangements are further examples of mating surface within the scope of the invention.

Aside from showing different possible mating surface arrangements between guide surface 5 and slide 6, FIGS. 3, 3*a*, 3*b*, and 3*c* also depict a threaded spindle 11 seated in a threaded bore of a tab 12 protruding from the lateral center, i.e., section 20*a* of the guide surface 5. Rotating the spindle 11 results in controlled continuous movement of the slide 6 along the guide surface 5 in the manner to be described infra.

As best seen in FIG. 4, there are provided in the slide 6 laterally displaced from and extending parallel to the spindle 11 on opposite sides thereof, elongate slots 17. Threaded bolts 13 are seated in the slots 17 and are received in threaded bores 14 sunk into the guide surface 5 and may serve selectively to secure the slide 6 against movement relative to the bracket 7 or clamp portion 9 for retaining the housing 26 of the monitor in the most favourable or efficacious position relative to the rail head 1.

Intermediate the slots 17 the slide 6 is also provided with coaxially arranged recesses 27 and 28 interconnected by a threaded spindle 11. The spindle 11 extends through the bore 28*a* from the recess 27 to the recess 28. The recess 27 is provided with axially displaced shoulders 27*a* and 27*b* and is of a width sufficient to accommodate a collar 15 affixed to the spindle 11. The collar 15 is secured against rotation relative to the spindle 11 by means of a clamp nut 25. Within the periphery of the collar 15 there is provided a plurality of radial bores 16, the purpose of which is to accommodate a tool for rotating the spindle 11. As seen in FIG. 4, the tab 12 extends from the guide surface 5 into the recess 28. The axial dimension of the tab being considerably less than that of the recess 28 to provide the space necessary for the desired elevational change in position of the slide or carriage 6, the direction of rotation of the spindle 11 determining the direction of movement of the slide 6. The axial surfaces of the collar 15 are in slidable engagement with the shoulders 27*a* and 27*b* of the recess 27. The slots 17 are, of course, of a longitudinal dimension substantially equal to, but not less than the length of the recess 28. As shown, the clamping bolts 13 and the tab 12 are located about in the longitudinal center of the slots 17 and recess 28, respectively, to allow movement of the slide relatively to the guide surface 5 in either direction.

Threaded bores 19 provided in the slide 6 and extending substantially parallel to the slots 17 are provided to receive bolts for mounting the housing 26 of the sensor on the slide.

As will be appreciated by persons skilled in the art the arresting and motion imparting arrangements described in connection with the embodiment of FIG. 3 are similarly applicable to the embodiments of FIGS. 3*a*, 3*b*, and 3*c* to that detailed descriptions in connection therewith are thought to be unnecessary.

Although the embodiments of the invention depicted and described hereinabove constitute preferred forms thereof, modifications may be made without leaving the ambit and scope of protection of the invention as set forth in the claims.

What is claimed is:

1. An apparatus for aligning monitoring means relative to the rail head of a rail, comprising:

bracket means having an opposite end portion provided with a first surface positioned in a substantially vertical plane;

means for supporting said monitoring means and which includes a second vertical surface;

a substantially vertically disposed recess of predetermined cross-sectional configuration in one of said first and second surfaces;

a protrusion having a cross-sectional configuration complementary to that of said recess in the other of said first and second surfaces;

means for releasably securing said bracket means to said supporting means with said first and second surfaces in contacting and mating engagement; and means for moving said supporting means vertically relative to said bracket means and comprising vertically disposed means rotatably mounted to and secured against axial movement relative to one of said bracket means and supporting means and threadedly connected to the other of said bracket means and supporting means.

2. The apparatus of claim 1, wherein the horizontal cross-sections of said recess and said protrusion each comprise three sides of a trapezoid, with the two opposite sides each being disposed at an acute angle relative to the third side.

3. The apparatus of claim 2, wherein said recess and said protrusion comprise a dovetail connection.

4. The apparatus of claim 1, wherein said securing means comprises a vertically disposed elongate slot in one of said bracket means and said supporting means and threaded means penetrating through said slot and connected to the other of said bracket means and supporting means.

5. The apparatus of claim 1, wherein the threaded connection of the vertically disposed means comprises thread locking means.

6. The apparatus of claim 1 wherein said securing means comprises a pair of laterally spaced apart and vertically disposed slots extending through one of said bracket means and said supporting means, and a threaded member extending through each of said slots and threadedly engaging the other of said bracket means and said supporting means.

7. The apparatus in claim 6 wherein said vertically disposed means is positioned between said pair of slots.

8. An apparatus for aligning monitoring means relative to the rail head of a rail, comprising:

bracket means having a first end portion affixed to said rail and having an opposite end portion provided with a first vertical surface positioned in a substantially vertical plane;

means for supporting said monitoring means and which includes a second vertical surface;

a substantially vertically disposed recess of predetermined cross-sectional configuration in one of said first and second surfaces;

a protrusion having a cross-sectional configuration complementary to that of said recess in the other of said first and second surfaces;

means comprising a movable member interconnected between said supporting means and said bracket means for moving said supporting means vertically relative to said bracket means in response to movement of said movable member; and said movable member comprises a vertically disposed threaded member which is rotatably mounted to and secured against axial movement relative to one of said bracket means and supporting means and threadedly connected to the other of said bracket means and supporting means.

9. The apparatus of claim 8 wherein said securing means comprises a pair of laterally spaced apart and vertically disposed slots extending through one of said bracket means and said supporting means, and a threaded member extending through each of said slots and threadedly engaging the other of said bracket means and said supporting means, and wherein said movable member is positioned between said pair of slots.

* * * * *

UNITED STATES PATENT AND TRADEMARK OFFICE

CERTIFICATE OF CORRECTION

PATENT NO. : 5,158,253

DATED : October 27, 1992

INVENTOR(S) : Jürgen Burghoff, et al.

It is certified that error appears in the above-identified patent and that said Letters Patent is hereby corrected as shown below:

Column 3, line 43, delete "6,," and insert -- 6" --.

Column 3, line 54, after "circumstances" insert -- . --.

Column 4, line 11, after "a" insert -- bore 28a. The bore 28a has a diameter larger than that of the --.

IN THE CLAIMS:

Column 4, line 55, after "having" insert -- a first end portion affixed to said rail and having --.

UNITED STATES PATENT AND TRADEMARK OFFICE

CERTIFICATE OF CORRECTION

PATENT NO. : 5,158,253

DATED : October 27, 1992

INVENTOR(S) : Jurgen Burghoff, et al.

It is certified that error appears in the above-indentified patent and that said Letters Patent is hereby corrected as shown below:

Column 6, after line 14, insert as a new paragraph,

--means for releasably securing said bracket means to said supporting means with said first and second surfaces in contacting and mating engagement;--.

Signed and Sealed this

Sixteenth Day of November, 1993

Bruce Lehman

*Attest:*

BRUCE LEHMAN

*Attesting Officer*

*Commissioner of Patents and Trademarks*